United States Patent [19]

Perry

[11] 4,055,909

[45] Nov. 1, 1977

[54] DISPLAY AND SCHEDULING PANELS WITH DOCUMENT HOLDING ENVELOPE

[76] Inventor: Loren Dale Perry, 414 Parliament Road, Martinez, Ga. 30907

[21] Appl. No.: 688,563

[22] Filed: May 21, 1976

[51] Int. Cl.[2] ..... G09F 1/10

[52] U.S. Cl. ..... 40/124.2

[58] Field of Search ..... 40/63, 159, 64, 125, 40/142 A, 124.2

[56] References Cited

U.S. PATENT DOCUMENTS

| | | | |
|---|---|---|---|
| 2,621,429 | 12/1952 | Teich | 40/68 |
| 3,091,046 | 5/1963 | Engelstein et al. | 40/159 X |
| 3,168,787 | 2/1965 | Surrey | 40/63 R X |
| 3,230,652 | 1/1966 | McNair | 40/63 R X |
| 3,419,979 | 1/1969 | McVicker et al. | 40/64 R |
| 3,466,774 | 9/1969 | Borresen | 40/159 X |
| 3,878,633 | 4/1975 | McWilliams | 40/63 R X |

*Primary Examiner*—Louis G. Mancene
*Assistant Examiner*—Wenceslao J. Contreras
*Attorney, Agent, or Firm*—Laurence R. Brown

[57] ABSTRACT

A display panel has a set of guides which in a preferred embodiment comprises a set of parallel track members upon each of which a plurality of riders are transported and frictionally held in place by means such as by a magnet. Thus, the riders may slide along the tracks singly or in a group and each rider may be removed in any position. Each rider includes a transparent pocket or envelope for receiving a document which displays the indicia or message. The pocket is hinged to the rider so that an internal folded document inserted into the pocket may be viewed from front and rear without removal of the document from the pocket.

7 Claims, 11 Drawing Figures

Figure 5:
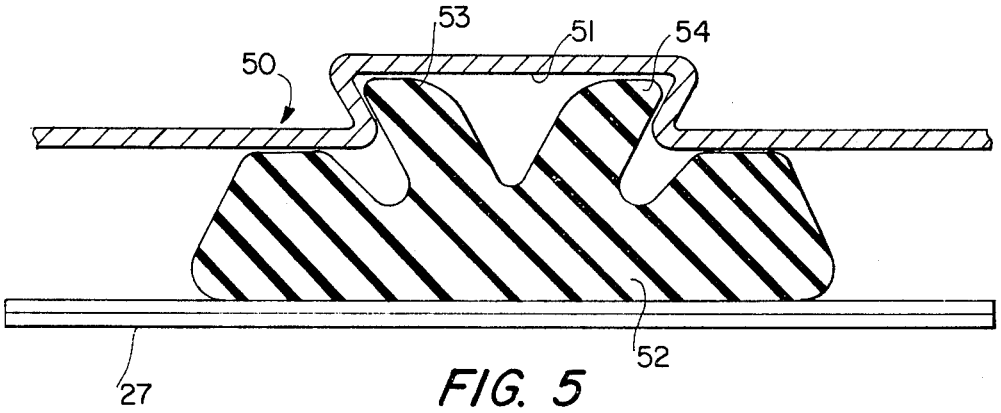

FIG. 1
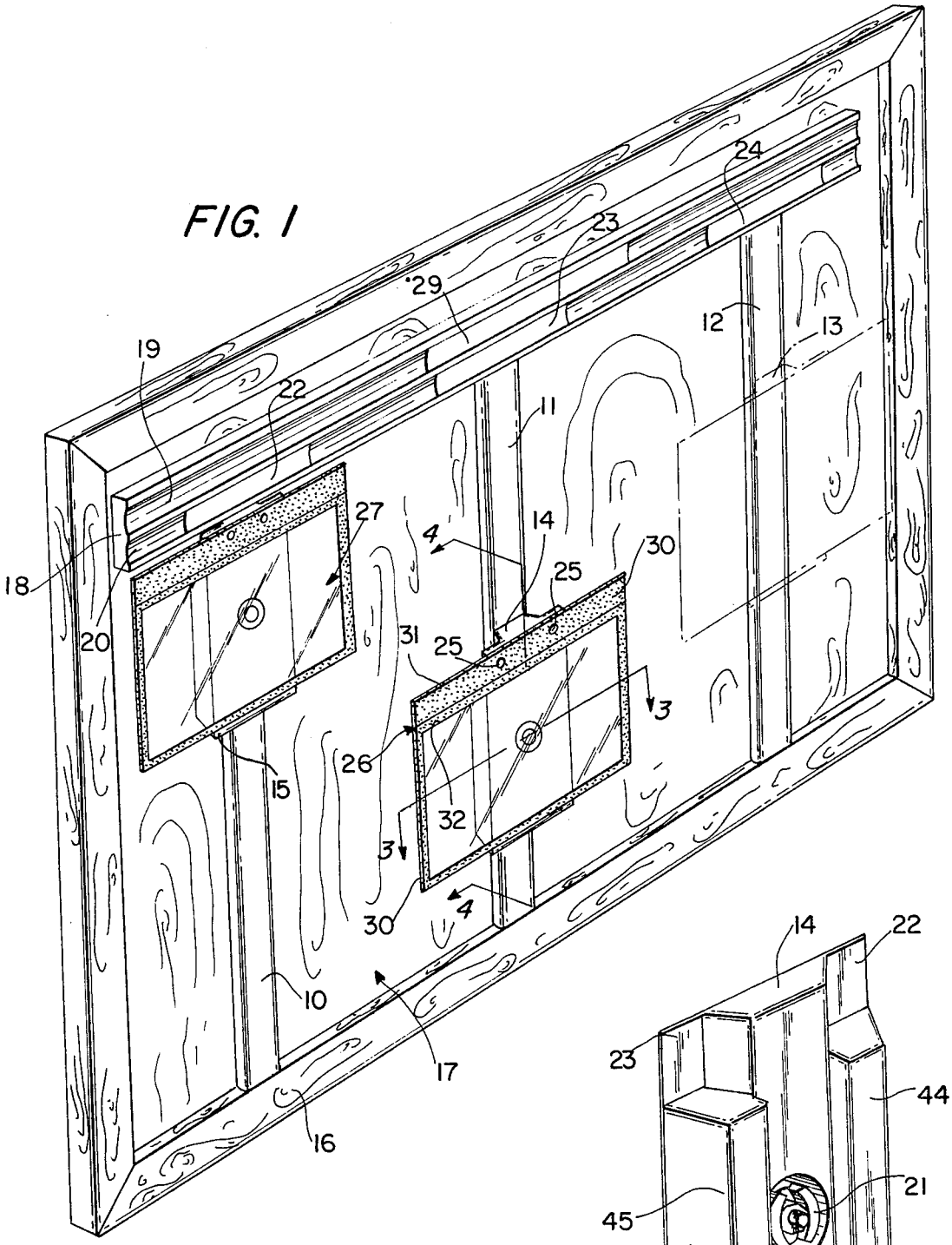
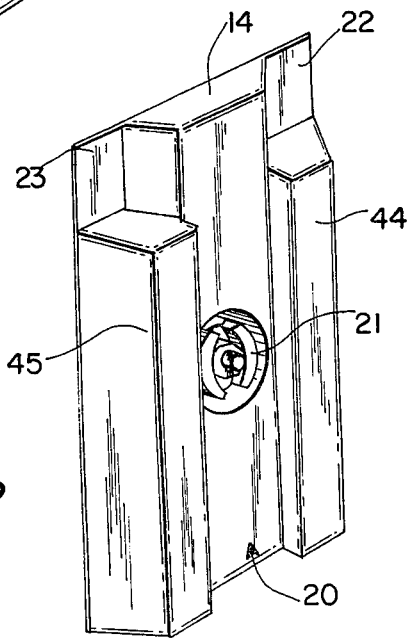
FIG. 2

FIG. 3
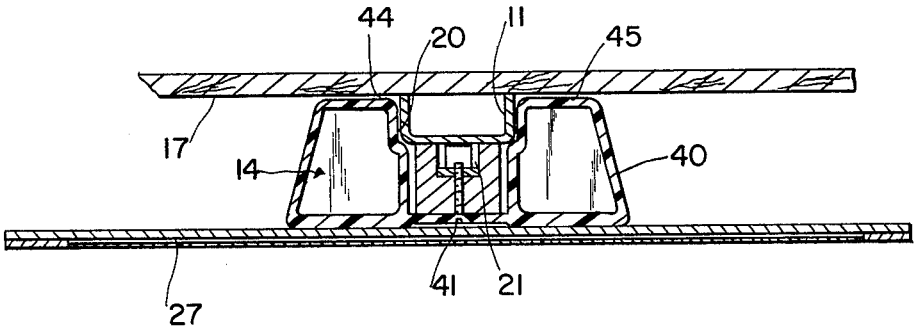
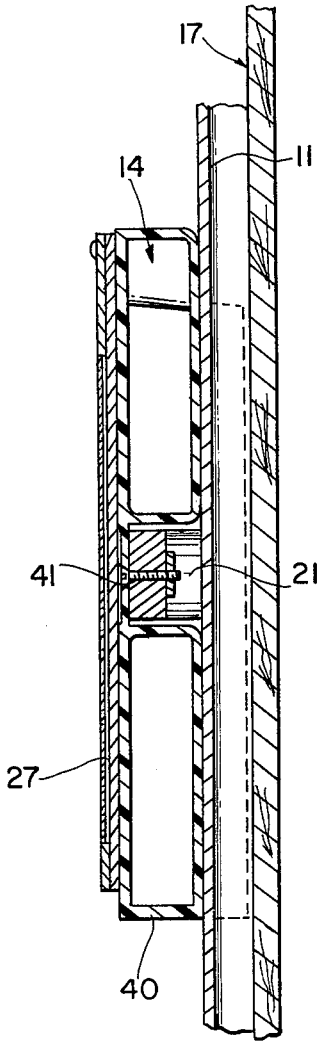
FIG. 4

DISPLAY AND SCHEDULING PANELS WITH DOCUMENT HOLDING ENVELOPE

This invention relates to display and scheduling panels and more particularly, it relates to display panels having a series of guiding tracks upon each of which a plurality of movable riders are frictionally held for manual movement along the track while permitting removal from the track at any position for replacement in another position.

BACKGROUND OF THE INVENTION

While various types of display and scheduling panels are known in the art, none has been satisfactory for such applications as shop scheduling or other applications where it is desirable for displaying and using non-permanent existing documents such as sales slips and work orders developed in the normal course of business as the display indicia.

Some prior art displays lack the flexibility of permitting movement of unitary or modular messages from any location on the panel to any other location. Others do not permit the simultaneous movement of groups of ordered modules.

Perhaps the most significant shortcoming or prior art panel type displays is the necessity to conform the panels to custom built indicia such as specially printed cards or lettered statements, etc.

OBJECTS OF THE INVENTION

It is therefore a general object of the invention to provide improved display and scheduling panel assemblies.

A more specific object of the invention is to provide a versatile panel assembly for displaying existing documents in an ordered sequence.

Another object of the invention is to provide display panel assemblies having modular messages which may be moved individually or in unison.

BRIEF DESCRIPTION OF THE INVENTION

Therefore in accordance with this invention, there is provided a scheduling type display panel having movable modular riders retained on a set of parallel track members by friction means overcomable by manual pressure to remove the modules from the track or to slide a set of modules simultaneously along the track. Each rider module includes a transparent envelope pocket for receiving and displaying an existing or precut document made in the course of business. Hinging means on the envelope permits visual observation of both sides of a folded document inserted in the pocket.

THE DRAWING

The foregoing and further objects, features and advantages of the invention will be found throughout the following detailed description and accompanying drawing, wherein:

FIG. 1 is a perspective view, partly in phantom, of a display scheduling panel provided by this invention, FIG. 2 is a rear perspective view of a modular rider display unit embodiment of the invention, FIG. 3 is a top section view looking downwardly of a modular rider unit in place on a channel track as taken along lines 3—3 in FIG. 1, FIG. 4 is a side section view of the rider unit in place as taken along lines 4—4 in FIG. 1, and FIGS. 5 to 11 are cross section sketches of various ridertrack arrangements.

THE DETAILED DESCRIPTION

Referring now to the drawing, wherein like reference characters are used throughout the several views to facilitate comparison, FIG. 1 shows one overall embodiment of the panel assembly provided by this invention. To simplify the drawing for understanding of the invention each of a plurality of parallel disposed vertical track U-shaped channel track members 10, 11, 12 is foreshortened showing only one rider module assembly 13, 14, 15 for each track. It is to be recognized that each rider module can be manually removed for positioning on any track and that a series of adjacent modules on any one track may be simultaneously pushed along the track in an ordered sequence for inserting another module at the end or between any two mounted modules.

The tracks 10, 11, 12 are mounted in a frame 16 preferably having a decorative back panel 17 of wood, corkboard or the like. For headlines, or identification legends a title panel 18 of wood or metal is provided at the top having two tracks 19, 20 into which permanent indicia strip panels 29, 22, 23, 24 may be inserted for identifying the panel function and that of the three tracks.

Typically the indicia panels could read "Shop Schedule" (29), "Adams" (22), "Smith" (23) and "Jones" (24), where the riders 15 etc. from top to bottom serve the spindling function of establishing priorities for allocation of shop time. Thus, there may be a need from time to time to reorder priorities while awaiting parts or for new emergencies, etc. Thus each rider such as shown in FIG. 2 is adapted with a friction mechanism for holding it in place on a track 10, 11, 12 until overcome by manual pressure to change position or track, etc.

While the rider unit 14 is shaped artistically of wood, plastic or metal for pleasant appearance, its functional construction simply comprises a channel 20 interfitting to ride along the U-shaped track members 10, 11, 12, etc., a frictional holding member such as a spring clip or clamp or simply the magnet 21 which adheres to ferrous tracks 10, 11, 12, when the rider 14 is wood, plastic or non-ferrous metal. The panel wings 22, 23 afford a mounting base for riveting at 24, 25 an open ended pocket shaped transparent envelope 26 so that it can be hinged back manually by bending at the rivets in this embodiment to view through either front or back transparent envelope panels 27.

The envelope 26 preferably has two celluloid or similar semistiff transparent panels 27 stitched together at three edges by a binder plastic material 30 and similarly bound on a single panel at the top of the back protruding panel section 31 and front lowered top section 32, leaving an open top pocket array. Inside this pocket can be inserted for visible access through front or back panels a sales slip, work order, invoice, etc. A larger document may be half folded for viewing through front and back panels or to put the key data in place for viewing through the front panel. A typical size envelope is 12.5 cm by 20.33 cm (5 inches by 8 inches) for receipt of a once folded sheet of the order of 24 by 18 cm, which is preferably a work order, parts list, invoice, shipping order form, etc. derived normally elsewhere in the course of a business transaction.

The details of a preferred panel and rider construction may be seen from FIGS. 3 and 4. The rider unit 14 may be hollow as shown with a plastic shell 40 wherein the magnet 21 is held by a screw 41 or rivet so that it contacts ferrous U-shaped channel track member 11 and holds the rider groove 20 centered and bottommed thereon, with the back rider surface flanges 44, 45 parallel to and adjacent the display panel surface 17. The envelope pocket panels 27 are held in place in a generally parallel arrangement with the display panel backboard member 17.

Other rider to track assemblies that might be used advantageously for some embodiments are set forth in the remaining Figures.

FIG. 5, for example, can have a metal or plastic back panel 50 with a track or riding channel 51 formed therein. The rider 52 is formed of flexible material such as rubber or plastic to form two compressible wings 53, 54 for insertion in riding channel 51 by squeezing together. The wings 53, 54 then elastically spread to frictionally hold the rider in place until overcome by manual pressure to slide in the channel 51 or to compress wings 53, 54 together for removal from the track.

Figure 6:
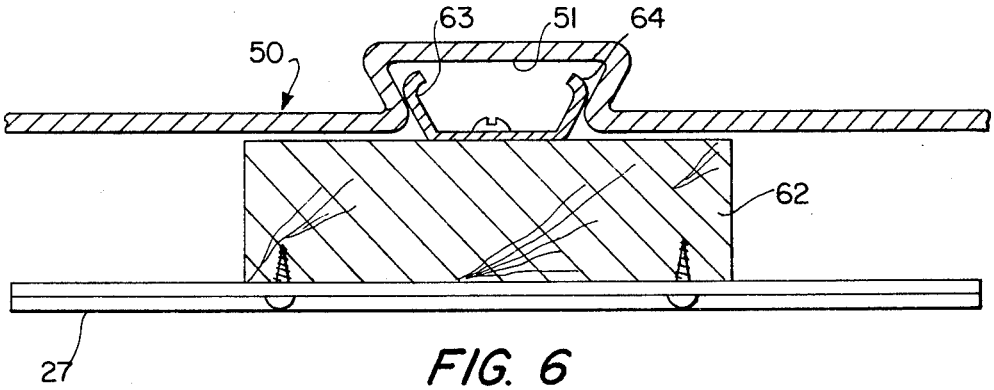

In the FIG. 6 embodiment, the rider 62 may be of wood and the friction means is a spring clip having compressible wings 63, 64.

Figure 7:
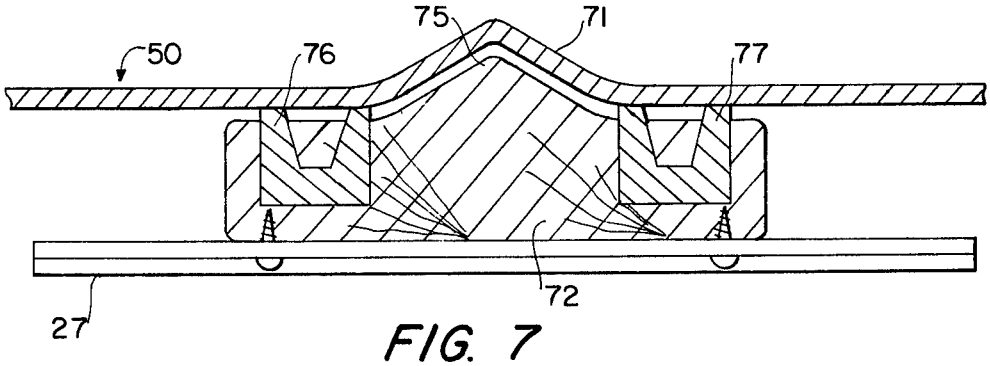

The shape of the track may change for ease in manufacturing, etc. as shown in FIG. 7. In this embodiment the track 71 is a triangular indentation in panel 50 which receives the mating triangular guide portion 75 of the rider block 72. This confines movement along the track 71. The rider is frictionally held in place by the pair of magnets 76, 77 located on either side of track 71.

Figure 8:
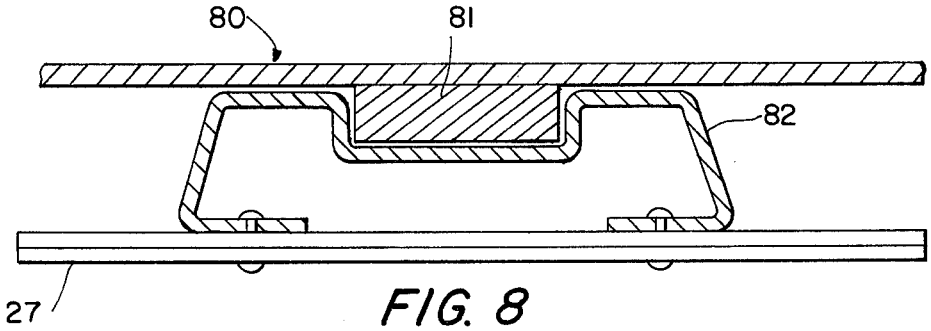

As shown in FIG. 8, a flat wood back panel 80 may have thereon magnet strip tracks 81, which receive a formed steel panel rider 82.

Figure 9:
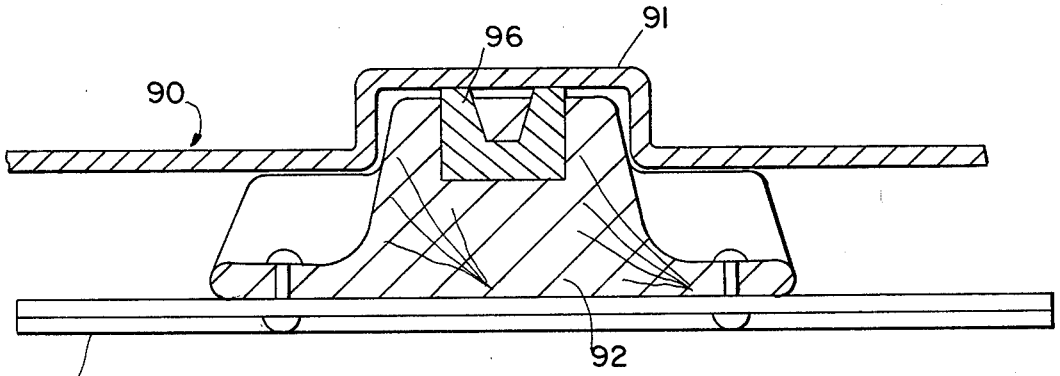

An indented rectangular track 91 formed in steel back panel 90 is used in FIG. 9 for receiving wood or plastic rider 92 by means of magnet 96. This is converse to the FIGS. 1 and 2 embodiment where the guiding track protrudes from the panel rather than being indented therein.

Figure 10:
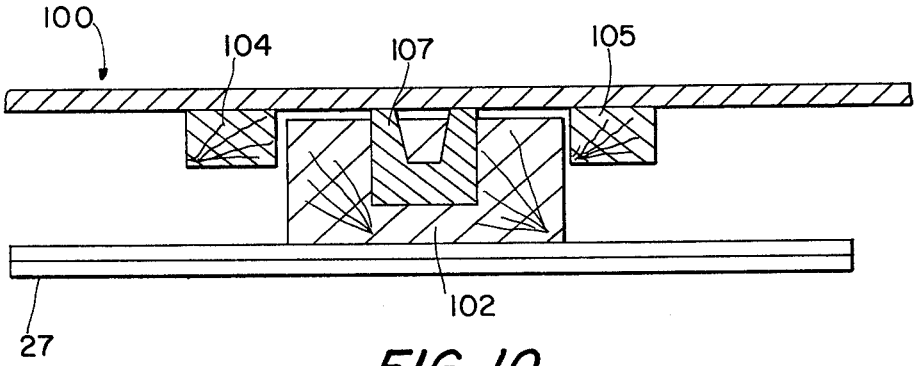

In FIG. 10 the back panel 100 is steel and blocks 103, 104 affixed thereto of any desired material such as wood form a guide for a rectangular rider 102 which is held to panel 100 by magnet 107.

Figure 11:
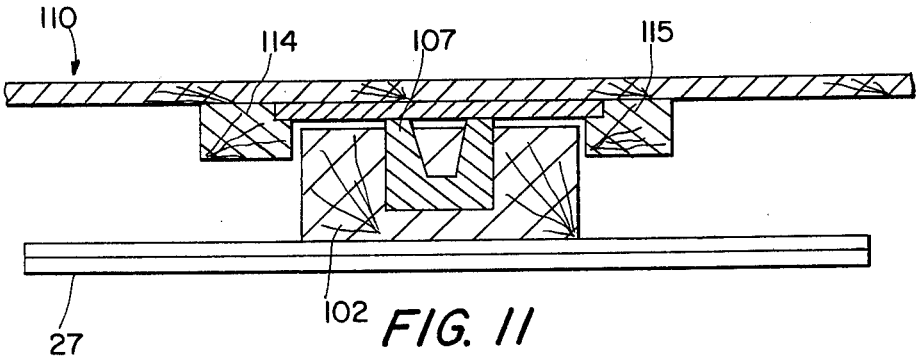

When the back panel 110 is wood, the variation of FIG. 11 can be used with a steel rod 111 insert for frictional contact with magnet 107. Panel 111 is held by indentations in wooden channel forming blocks 114, 115 for example.

It is therefore evident from the foregoing preferred embodiment of the invention that other sizes, shapes and arrangements of display and scheduling panels can be made without departing from the spirit and scope of the invention, which is defined with particularity in the appended claims.

What is claimed is:

1. Display means for holding a plurality of documents of variable size fully visible in ordered sequence, comprising in combination, a set of longitudinally disposed guide members arranged on a panel for retaining said documents in said ordered sequence, a plurality of riders adapted for retention on and movement along said guide members each for displaying one of said documents, friction means holding said riders frictionally in position on said guide members and permitting sliding movement therealong when the friction is manually overcome, transparent envelope means affixed to said riders for visibly retaining removably inserted indicia documents of different dimensions, and wherein said guide members comprise a set of parallel linear members disposed upon a panel whereby documents prepared in the normal course of business such as work orders, sales slips and invoices are held in said ordered sequence subject to removal and reordering of both the riders and the documents along said guide members.

2. Display means as defined in claim 1, wherein said guide members and panel comprise respectively a ferrous material and a magnet, and said friction means comprise said magnet in contact with the ferrous material.

3. Display means as defined in claim 1, wherein said friction means includes quick release means removably releasing said riders by manual pressure from any position along said guide members to replace in position in another ordered sequence.

4. Display means as defined in claim 1, wherein the envelopes have transparent front and back panels and hinging means to permit visual inspection through the back panel.

5. Display means as defined in claim 1, wherein the riders and guide members have mating grooves therein to fit together confining the rider movement.

6. Display means as defined in claim 1, including a decorative panel holding said guide members in parallel vertical column relationship and having thereon a title panel adapted to retain semi-permanent indicia in two horizontal rows for identifying respectively the panel function of each vertical column of riders and general indicia related to the entire display.

7. Display means for holding a plurality of documents of variable size fully visible in ordered sequence, comprising in combination, a set of longitudinally disposed guide members arranged on a panel for retaining said documents in said ordered sequence, a plurality of riders adapted for retention on and movement along said guide members each for displaying one of said documents, friction means holding said riders frictionally in position on said guide members and permitting sliding movement therealong when the friction is manually overcome, and transparent envelope means affixed to said riders for visibly retaining removably inserted indicia documents of different dimensions, whereby documents prepared in the normal course of business such as work orders, sales slips and invoices are held in said ordered sequence subject to removal and reordering of both the riders and the documents along said guide members, wherein said envelope means comprises an open top bendable envelope material having front and back transparent panels affixed to said rider only at the center top thereby to permit visual inspection of indicia in said envelope from the back side by bending of the material without removal of said riders from said channel members.

* * * * *